United States Patent [19]

Holman

[11] 4,331,269

[45] May 25, 1982

[54] NOZZLE ADAPTER FOR TILT ACTUATED NOZZLE DOWN VALVES

[75] Inventor: William M. Holman, St. Peters, Mo.

[73] Assignee: Clayton Corporation, St. Louis, Mo.

[21] Appl. No.: 168,186

[22] Filed: Jul. 10, 1980

[51] Int. Cl.[3] ..... B65D 83/14

[52] U.S. Cl. ..... 222/402.21; 222/567; 251/349

[58] Field of Search ..... 222/402.13, 402.21, 222/402.22, 402.23, 402.24, 402.25, 528, 529, 567, 570; 239/390, 391, 577; 251/349, 351

[56] References Cited

U.S. PATENT DOCUMENTS

| | | | |
|---|---|---|---|
| 2,750,230 | 6/1956 | Soffer et al. | 251/349 |
| 3,101,875 | 8/1963 | Michel | 222/402.22 |
| 3,367,545 | 2/1968 | Cook | 222/389 |
| 3,434,633 | 3/1969 | Green | 222/402.13 |
| 3,648,905 | 3/1972 | Kauder | 222/402.21 |
| 3,758,007 | 9/1973 | Rosen | 222/402.23 X |
| 3,901,410 | 8/1975 | Schultz | 222/402.22 X |
| 3,920,165 | 11/1975 | Schultz | 222/402.23 |
| 4,165,829 | 8/1979 | Hansen | 222/402.22 |

*Primary Examiner*—Gil Weidenfeld
*Assistant Examiner*—Fred A. Silverberg
*Attorney, Agent, or Firm*—Neal Kalishman

[57] ABSTRACT

A dispensing nozzle adapter for use in conjunction with nozzle down valves that are utilized in pressurized container applications. The nozzle encloses the stem and has a top portion which can be cut to create a desired nozzle opening. The bottom portion of the nozzle contains a lug which snaps over the flared section of the stem of the valve. The lug not only immovably locks the nozzle to the valve but also forms a seal with the flexible section of the valve.

2 Claims, 3 Drawing Figures

NOZZLE ADAPTER FOR TILT ACTUATED NOZZLE DOWN VALVES

BACKGROUND OF THE INVENTION

I. FIELD OF THE INVENTION

The present invention is directed to sealed adapter for a valve of an aerosol container. Specifically, the invention is concerned with aerosol valve adapters to allow dispensing of a smooth ribbon of product and prevent dispensing of product due to premature activation of the valve.

II. DESCRIPTION OF THE PRIOR ART

There are many applications where it is desirable to utilize an aerosol or pressurized container to dispense products. In many of these applications it is necessary to obtain a smooth bead of product during dispensing. Examples of such situations are the dispensing of caulks, adhesives, creams, etc.

It is also usually desirable to prevent premature dispensing of an aerosol product in order to avoid loss of product, product spoilage or clogging of the valve. A conventional valve can be activated with relative ease to sample product prior to sale or if mishandled to dispense the product inadvertently. This undesirable dispensing of the product can result in significant product waste and economic loss.

There have been several proposals for alleviating the aforementioned problems. Such solutions usually require that conventional valves be discarded in favor of radically different valve and adapter designs. These valves and adapters have not met with success since the cost of tooling the valves and adapters is prohibitive. They usually cannot be easily molded and they normally require a multistep securing process in order to fit them to containers.

Also, valve covers have been proposed as a means of avoiding product contact with the metal portion of the valve. These covers utilize elastomeric materials which are relatively soft and therefore require excess material in order to obtain sufficient rigidity. This renders then an insufficient solution to the aforementioned problems.

The present invention is advantageous in that it provides a valve cover or adapter which prevents premature activation of the valve. Further, the adapter is inexpensive to manufacture and highly reliable. Also, it forms the product into a smooth bead as the product is being dispensed from the container and provides a product seal which prevents valve clogging.

SUMMARY OF THE INVENTION

The present invention provides an aerosol container comprising a tilt actuating valve having the improvement which comprises a sealed cone shaped nozzle which is fixedly attached to said valve.

DESCRIPTION OF THE PREFERRED EMBODIMENTS

Figure 1:
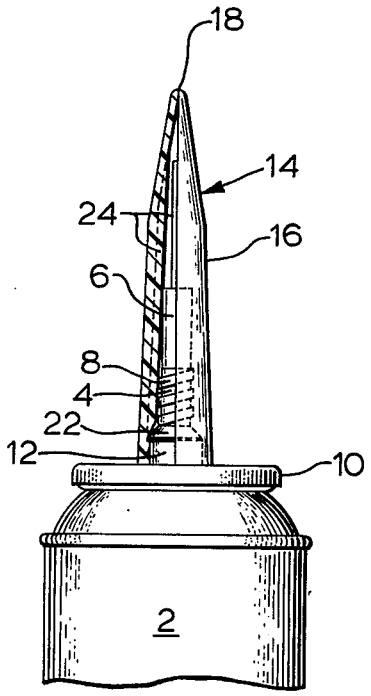
FIG. 1 is a fragmentary perspective view of the invention.
Figure 2:
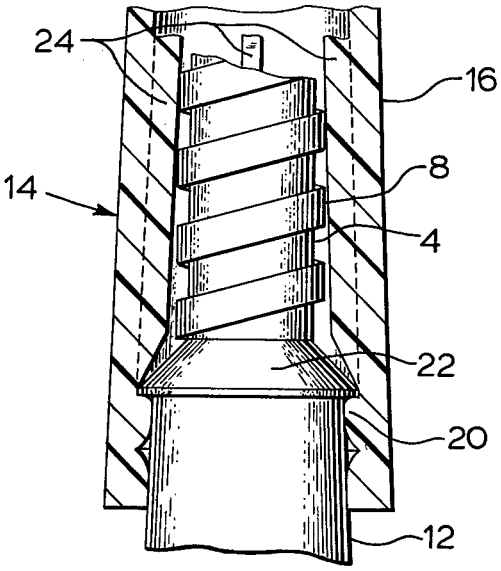
FIG. 2 is a partial sectional view of the invention.
Figure 3:
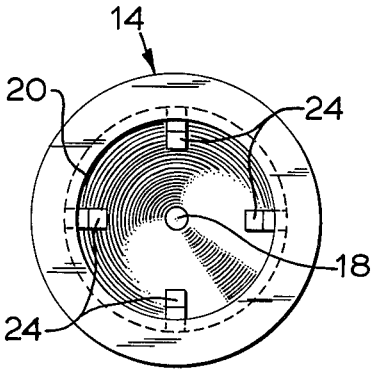
FIG. 3 is a bottom view of the sealed adapter of the invention.

The present invention is directed to an adapter nozzle that can be attached to a conventional aerosol can actuating valve. FIGS. 1, 2, and 3 illustrate the nozzle 14 of the invention. The aerosol can has a body 2 with an actuating valve 4.

The valve 4 is a springless nozzle down tilt actuating valve. A valve with a spring can be used. It is only important that the valve 4 be tilt actuating having a straight stem 6 a flexible section 12 and a flared section 22. The stem usually has threads 8. Supporting the stem 6 and the mounting cup 10 is a flexible section 12. The flexible section 12 is preferably made from rubber and functions to maintain the valve in a closed and sealed position when not being actuated.

The nozzle 14 is tapered and preferably has a cone shape. That is, it has a cylindrical body 16 with a pointed tapered closed top 18. The bottom inside wall of the cylindrical body 16 has a horizontal or locking lug 20 and may be a continuous rim or a number of projections, at least three, evenly spaced along the bottom of the interior body 16. The locking lug 20 snaps over the flared section 22 of stem 6. The interior of the cylindrical body 16 may also have vertical ribs 24 which serve to maintain the stem 6 in the same relative position to the nozzle 14. Without the ribs 24 there can be a lag time between the tilting of the nozzle 14 and the activation of the valve 4 due to the space between the interior of the cylindrical body 16 and the stem 6.

The nozzle 14 must be made from a nonelastomeric thermoplastic material in order for it to be suitably rigid. It is preferably made from olefin plastics (low and high density polyethylene and polypropylene). Also suitable are the polyacetels, acrylics, polyamides, polyesters, ABS, polystyrene, SAN, polyimides, polyurethenes, polycarbonates, PVC, vinyls, etc.

The nozzle of the invention not only serves as the cap for the aerosol can but also as a dispensing tip. When it is desired to obtain product from the aerosol can, the top of the nozzle is cut off. The nozzle is tilted which causes the valve to tilt in the conventional manner. The product will then flow through the valve and out the nozzle in the form of a smooth bead. Until the top of the nozzle is cut off no product can escape from the can by premature activation of the valve. Also, if the nozzle opening becomes clogged, the closed portion can be cut off or punctured. The valve is prevented from clogging since the residue product in the nozzle provides a seal.

The nozzle or adapter 14 can be molded inexpensively due to its simple design. Since a conventional valve 4 is utilized, the adapter can be incorporated into existing aerosol delivery systems. The present invention is an economically feasible solution to the problem of premature activation of an aerosol valve due to the use of conventional valves, an inexpensively molded adapter and the ease with which the adapter is secured to the valves by a single snapping operation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all charges which come within the meaning and range of equivalency of the claims are therefore intended to be embraced therein.

I claim:

1. A nonelastic thermoplastic adapter nozzle that is attachable to a tilt actuated nozzle down valve , wherein said valve is located on a container and is a spring less nozzle down tilt actuating valve comprising a straight stem section, a flexible stem section, a section of threads located between the straight stem section and the flexible stem section, and a flared section located between the threads and the flexible, stem section, said adapter nozzle comprising a top portion which is suitable for cutting to a desired size opening, a body portion which encloses the stem of the valve, and a bottom portion which has a lug on its interior surface that snaps over and abuts the flared section of the valve and forms an immobile sealing relationship with the flexible section of the valve, wherein the nozzle is tapered from the bottom section to the top section along both the interior surface of the body portion of the nozzle contains a plurality of vertical ribs, wherein the ribs engage both an outermost portion of the threads and the straight stem section.

2. The nozzle of claim 1 wherein the container is pressurized.

* * * * *